US007131404B2

(12) United States Patent
Nishikawa et al.

(10) Patent No.: US 7,131,404 B2
(45) Date of Patent: Nov. 7, 2006

(54) COMBUSTION-TYPE POWER TOOL HAVING GAS CANISTER COOLING ARRANGEMENT

(75) Inventors: Tomomasa Nishikawa, Hitachinaka (JP); Yoshitaka Akiba, Hitachinaka (JP); Shoichi Hirai, Hitachinaka (JP); Haruhisa Fujisawa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/208,586

(22) Filed: Aug. 23, 2005

(65) Prior Publication Data

US 2006/0042572 A1 Mar. 2, 2006

(30) Foreign Application Priority Data

Aug. 24, 2004 (JP) ..... P2004-244149

(51) Int. Cl.
*F02B 71/00* (2006.01)
*F02P 5/00* (2006.01)

(52) U.S. Cl. ..... 123/46 H; 123/46 R

(58) Field of Classification Search ..... 123/46 R, 123/46 H

See application file for complete search history.

(56) References Cited

U.S. PATENT DOCUMENTS 4,522,162 A 6/1985 Nikolich
5,197,646 A 3/1993 Nikolich
5,482,445 A * 1/1996 Achten et al. ..... 417/362
6,019,072 A * 2/2000 Phillips et al. ..... 123/46 H
2006/0042573 A1* 3/2006 Nishikawa et al. ..... 123/46 H
2006/0042574 A1* 3/2006 Nishikawa et al. ..... 123/46 H

FOREIGN PATENT DOCUMENTS

EP 0 857 546 8/1998
EP 1 588 804 10/2005
EP 1 595 653 11/2005

* cited by examiner

*Primary Examiner*—Stephen K. Cronln
*Assistant Examiner*—Jason Benton
(74) *Attorney, Agent, or Firm*—Antonelli, Terry, Stout and Kraus, LLP

(57) ABSTRACT

A combustion-type power tool having a cooling arrangement for cooling a gas canister. The tool includes a housing having a gas canister accommodating section in which a gas canister is accommodated. An air passage is defined between the gas canister accommodating section and the gas canister accommodated therein. The gas canister accommodating section is formed with an air inlet port in communication with the air passage for introducing air into the air passage. Since air flows along the gas canister, the gas canister can be cooled. If the tool is provided with a fan, the rotation of the fan causes air suction passing through the air passage.

6 Claims, 1 Drawing Sheet

COMBUSTION-TYPE POWER TOOL HAVING GAS CANISTER COOLING ARRANGEMENT

BACKGROUND OF THE INVENTION

The present invention relates to a combustion-type power tool, and more particularly, to such power tool capable of driving a fastener such as a nail, an anchor, and a staple into a workpiece.

In a conventional combustion-type driving tool such as a nail gun, a mixture of air and gaseous fuel injected into a combustion chamber is ignited by a spark at an ignition plug to cause gas expansion in the combustion chamber, which in turn causes a linear momentum of a piston. By the movement of the piston, a nail is driven into a workpiece. Such conventional combustion-type nail gun is described in U.S. Pat. No. 5,197,646 and Japanese Patent Publication No. H03-25307.

According to the conventional combustion-type power tool, a temperature of an entire tool including a gas canister is increased by heat generated upon combustion in a combustion chamber, particularly upon repeated operation, for example, continuous nail driving operation. As a result, an inner pressure of the gas canister will be increased thereby increasing an injection rate of the combustible gas. In the combustion-type power tool, air-fuel mixture can be ignited if gas density in the combustion chamber (amount of combustible gas per an entire inner volume of the combustion chamber) is within a predetermined range. If the injection amount of the combustible gas is increased, i.e., if density of the combustible gas is increased, ignition does not occur, or sufficient expansion capable of driving a nail into a workpiece cannot be provided due to insufficient ignition.

SUMMARY OF THE INVENTION

It is therefore, an object of the present invention to provide a combustion-type power tool capable of stabilizing a gas canister within a desirable temperature thereby providing injection with a constant amount of combustible gas, to thus realizing a stabilized ignition performance in a combustion chamber.

This and other object of the present invention will be attained by a combustion-type power tool including a housing, a cylinder head, a cylinder, a piston, a combustion chamber frame, a driver blade, and an ignition plug.

The housing includes a gas canister accommodating section and has one end and another end. The cylinder head is disposed at the one end and formed with a fuel passage allowing a combustible gas from the gas canister to pass therethrough. The cylinder is disposed in and fixed to the housing and defines an axial direction. The piston is slidably disposed in the cylinder and reciprocally movable in the axial direction. The piston divides the cylinder into an upper space above the piston and a lower space below the piston. The combustion chamber frame is disposed in the housing and movable in the axial direction. The combustion chamber frame is abuttable on the cylinder head to provide a combustion chamber in cooperation with the cylinder head and the piston. The driver blade extends in the axial direction from the piston in the lower space. The ignition plug is exposed to the combustion chamber for igniting a mixture of air and the combustible gas in the combustion chamber.

An air passage is defined between the gas canister accommodating section and the gas canister accommodated therein. The gas canister accommodates section being formed with an air inlet in communication with the air passage.

In another aspect of the invention, there is provided a gas canister cooling arrangement in a combustion-type power tool having a housing. The housing included a gas canister accommodating section for accommodating therein a gas canister. An air passage is defined between the gas canister accommodating section and the gas canister accommodated therein. An air inlet of the air passage is formed at the gas canister accommodating section.

In another aspect of the invention, there is provided a combustion-type power tool including an outer frame. The outer frame includes a gas canister accommodating section for accommodating a gas canister. The gas canister insertion opening is provided in the canister accommodating section. An air passage is defined between the gas canister accommodating section and the gas canister accommodated therein. The gas canister accommodating section is formed with an air inlet in communication with the air passage. The air inlet is independent of the canister insertion opening.

BRIEF DESCRIPTION OF THE DRAWINGS

In the single drawing.

DETAILED DESCRIPTION OF THE PREFERRED EMBODIMENTS

Figure 1:
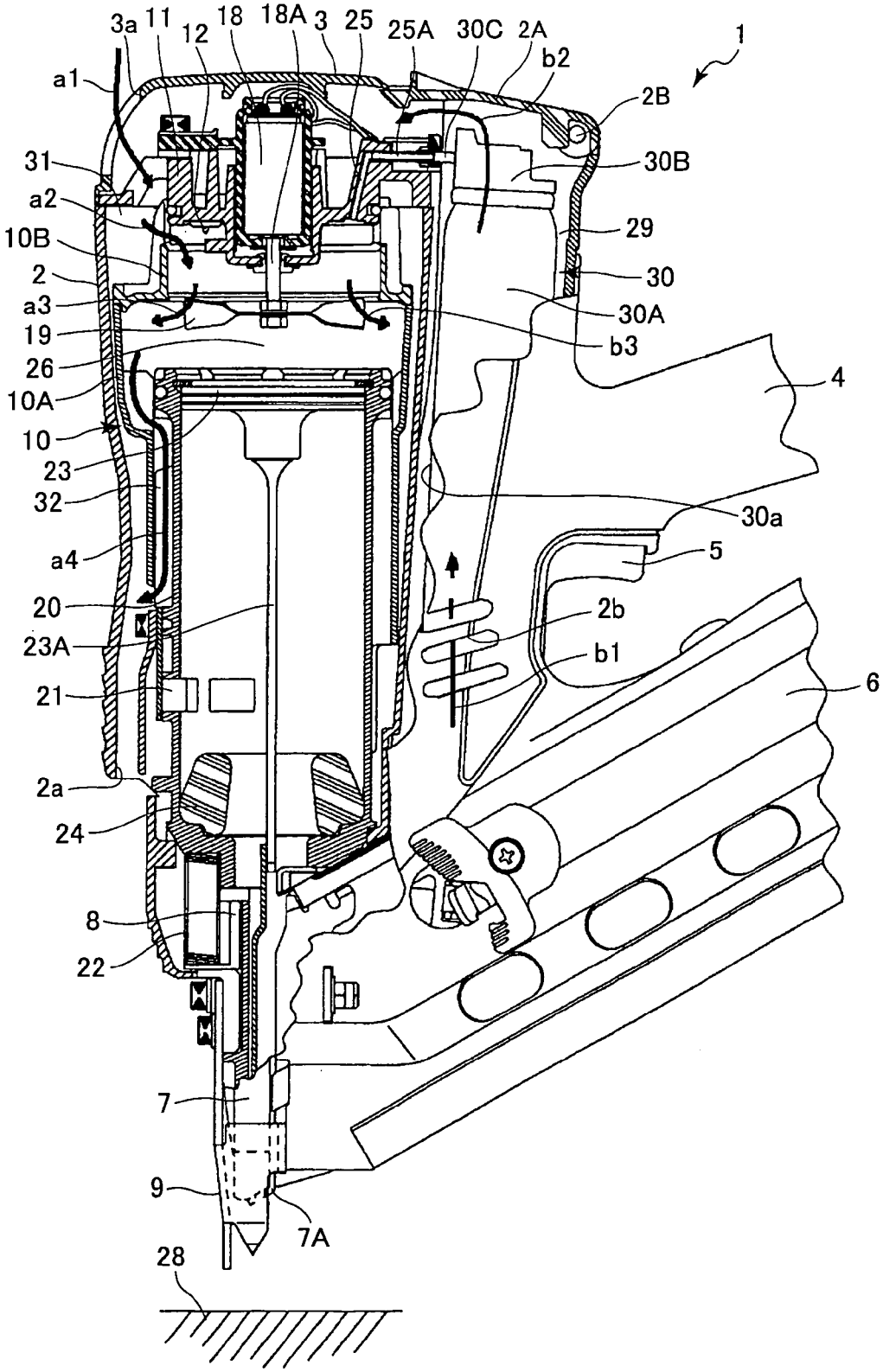
FIG. 1 is a vertical cross-sectional side view showing a combustion-type nail gun embodying a combustion-type power tool according to an embodiment of the present invention, the nail gun being in an initial phase prior to nail driving operation.

A combustion-type power tool according to one embodiment of the present invention will be described with reference to FIG. 1. The embodiment pertains to a combustion-type nail gun. The combustion-type nail gun 1 has a housing 2 constituting an outer frame. The housing 2 is formed with an exhaust port 2*a*. A head cover 3 formed with an intake port 3*a* is mounted on the top of the housing 2. A handle 4 is attached to the housing 2 and extends from a side of the housing 2.

The handle 4 has a trigger switch 5 and accommodates therein a battery (not shown). The battery is detachably disposed in the handle 4. A canister housing 29 is provided in the housing 2 at a position immediately beside the handle 4. In the depicted embodiment shown in FIG. 1, a right side part of the housing 2 is made integrally with the handle 4. Therefore, the canister housing 29 is defined by a material of the handle 4 and a material of the housing 2.

The canister housing 29 is formed with an air inlet port 2*b* at a position near one end of a gas canister 30. The gas canister 30 is detachably disposed in the canister housing 29. The canister housing 29 has a canister insertion opening through which the gas canister 30 is inserted into the canister housing 29. A pivot shaft 2B protrudes from the canister housing 29, and a cover 2A is pivotally supported to the pivot shaft 2B for opening and closing the canister insertion opening. The gas canister 30 includes an accumulating section 30A for accumulating therein a combustible liquidized gas, and a gauging section 30B provided at an end of the accumulating section 30A for allowing the liquidized gas to pass therethrough at a constant amount. The gauging section 30B is provided with an injection rod 30C connected to a gas canister connecting portion 25A provided in a cylinder head 11 (described later). An air passage 30*a* for allowing air to pass therethrough is defined between a wall surface of the canister housing 29 and an outer surface of the gas canister 30. A magazine 6 for containing therein nails (not shown) is provided at a lower side of the handle 4.

A nose 7 extends from an end of the housing 2, the end being opposite to the head cover 3. The nose 7 is formed integrally with a cylinder 20 (described later) and has a tip end in confrontation with a workpiece 28. The nose 7 is adapted for guiding sliding movement of a drive blade 23A (described later) and the nail. A push lever 9 is movably provided and has a lower portion slidable with respect to a lower end portion 7A of the nose 7. The push lever 9 has a tip end adapted to be pressed against the workpiece 28, and has an upper end portion associated with an arm member 8 fixed to a base section 10A of a combustion-chamber frame 10 which will be described later.

A compression coil spring 22 is interposed between the arm member 8 and the cylinder 20 for normally urging the push lever 9 in a protruding direction away from the head cover 3. When the housing 2 is pressed toward the workpiece 28 while the push lever 9 is in abutment with the workpiece 28 against a biasing force of the compression coil spring 22, an upper portion of the push lever 9 is retractable into the housing 2.

A cylinder head 11 is secured to the top of the housing 2 for closing the open top end of the housing 2. The cylinder head 11 supports a motor 18 at a position opposite to a combustion chamber 26 described later. Further, an ignition plug 12 is also supported to the cylinder head 11 at a position adjacent to the motor 18. The ignition plug 12 has an ignition spot exposed to the combustion chamber 26. The ignition plug 12 is ignitable upon manipulation to the trigger switch 5 and upon movement of the combustion chamber frame 10 to its predetermined position because of the pressing of the push lever 9 against the workpiece 28. The motor 18 has a rotation shaft 18A to which a fan 19 positioned in the combustion chamber 26 is fixed.

The cylinder head 11 has a handle side in which is formed a fuel injection passage 25 which allows a combustible gas to pass therethrough. One end of the fuel injection passage 25 serves as an injection port that opens at the lower surface of the cylinder head 11. Another end of the fuel injection passage 25 is engaged with the gas canister connecting portion 25A in communication with the injection rod 30C. The combustion-chamber frame 10 is provided in the housing 2 and is movable in the lengthwise direction of the housing 2. The combustion chamber frame 10 includes the base section 10A and a head section 10B extending from the base section 10A at a position opposite to the push lever 9.

A head switch (not shown) is provided in the housing 2 for detecting an uppermost stroke end position of the combustion chamber frame 10 when the nail gun 1 is pressed against the workpiece 28. The head switch can be turned ON when the push lever 9 is elevated to a predetermined position for starting rotation of the motor 18.

Since the arm member 8 is fixed to the base section 10A, the combustion chamber frame 10 is moved in accordance with the movement of the push lever 9. The cylinder 20 is fixed to the housing 2. The combustion chamber frame 10 has an inner surface in sliding contact with the cylinder 20. Thus, the cylinder 20 guides movement of the combustion chamber frame 10. The cylinder 20 has an axially intermediate portion formed with an exhaust hole 21. An exhaust-gas check valve (not shown) is provided to selectively close the exhaust hole 21.

A piston 23 is slidably and reciprocally provided in the cylinder 20. The piston 23 divides an inner space of the cylinder 20 into an upper space above the piston 23 and a lower space below the piston 23. The driver blade 23A extends downwards from a side of the piston 23, the side being at the cylinder space below the piston 23, to the nose 7. The driver blade 23A is positioned coaxially with the nail setting position in the nose 7, so that the driver blade 23A can strike against the nail during movement of the piston 23 toward its bottom dead center. Further, a bumper 24 is provided on the bottom of the cylinder 20. The bumper 24 is made from a resilient material. When the piston 23 moves to its bottom dead center, the piston 23 abuts on the bumper 24 and stops. In this case, the bumper 24 absorbs a surplus energy of the piston 23.

When the upper end of the combustion-chamber frame 10 abuts on the cylinder head 11, the cylinder head 11, the combustion-chamber frame 10, and the upper cylinder space above the piston 23 define in combustion the combustion chamber 26. When the combustion-chamber frame 10 is separated from the cylinder head 11, a first flow passage 31 in communication with an atmosphere is provided between the cylinder head 11 and the upper end portion of the combustion-chamber frame 10, and a second flow passage 32 in communication with the first flow passage 31 is provided between the lower end portion of the combustion-chamber frame 10 and the upper end portion of the cylinder 20. These flow passages 31, 32 allow a combustion gas and a fresh air to pass along the outer peripheral surface of the cylinder 20 for discharging these gas through the exhaust port 2*a* of the housing 2. Further, the above-described intake port 3*a* is formed for supplying a fresh air into the combustion chamber 26, and the exhaust hole 21 is adapted for discharging combustion gas generated in the combustion chamber 26.

Rotation of the fan 19 performs the following three functions. First, the fan 19 stirs and mixes the air with the combustible gas as long as the combustion chamber frame 10 remains in abutment with the cylinder head 11. Second, after the mixed gas has been ignited, the fan 19 causes turbulent combustion of the air-fuel mixture, thus promoting the combustion of the air-fuel mixture in the combustion chamber 26. Third, the fan 19 performs scavenging such that the exhaust gas in the combustion chamber 26 can be scavenged therefrom and also performs cooling to the combustion chamber frame 10 and the cylinder 20 when the combustion chamber frame 10 moves away from the cylinder head 11 and when the first and second flow passages 31, 32 are provided.

Next, operation of the combustion-type nail gun 1 will be described. In the non-operational state of the combustion-type nail gun 1, the push lever 9 is biased away from the cylinder head 11 as shown in FIG. 1 by the biasing force of the compression coil spring 22, so that the push lever 9 protrudes from the lower end of the nose 7. Thus, the uppermost end portion of the head section 10B is spaced away from the cylinder head 11 because the arm member 8 connects the combustion chamber frame 10 to the push lever 9. Further, a part of the combustion chamber frame 10 which part defines the combustion chamber 26 is also spaced away from the top portion of the cylinder 20. Hence, the first and second flow passages 31 and 32 are provided. In this condition, the piston 23 stays at its top dead center in the cylinder 20.

With this state, if the push lever 9 is pushed onto the workpiece 28 while holding the handle 4 by a user, the push lever 9 is moved toward the cylinder head 11 against the biasing force of the compression coil spring 22. At the same time, the combustion chamber frame 10 which is associated with the push lever 9 through the arm member 8 is also moved toward the cylinder head 11, closing the above-described flow passages 31 and 32. Thus, the sealed combustion chamber 26 is provided.

In accordance with the movement of the push lever 9, the liquidized gas in the gas canister 30 is injected into the combustion chamber 26 through the gas canister connecting portion 25A and through the fuel injection passage 25.

Further, in accordance with the movement of the push lever 9, the combustion-chamber frame 10 reaches its uppermost stroke end whereupon the head switch is turned ON to energize the motor 18 for starting rotation of the fan 19. Rotation of the fan 19 stirs and mixes the combustible gas with air in the combustion chamber 26.

In this state, when the trigger switch 5 provided at the handle 4 is turned ON, spark is generated at the ignition plug 12 to ignite the combustible gas. The combusted and expanded gas pushes the piston 23 to its bottom dead center. Therefore, a nail in the nose 7 is driven into the workpiece 28 by the driver blade 23A until the piston 23 abuts on the bumper 24.

After the nail driving, the piston 23 strikes against the bumper 24, the cylinder space above the piston 23 becomes communicated with the exhaust hole 21. Thus, the high pressure and high temperature combustion gas is discharged out of the cylinder 20 through the exhaust hole 21 of the cylinder 20 and through the check valve (not shown) provided at the exhaust hole 21 to the atmosphere to lower the pressure in the combustion chamber 26. When the inner space of the cylinder 20 and the combustion chamber 26 becomes the atmospheric pressure, the check valve is closed.

Combustion gas still remaining in the cylinder 20 and the combustion chamber 26 has a high temperature at a phase immediately after the combustion. However, the high temperature can be absorbed into the walls of the cylinder 20 and the combustion chamber frame 10. Thus, temperature of the cylinder 20 and the gas canister 30 will be elevated. The absorbed heat is diffused to the atmosphere from the cylinder 20 and the combustion chamber frame 10.

Absorption of the heat into the cylinder 20 etc. causes rapid cooling to the combustion gas. Thus, the pressure in the sealed space in the cylinder 20 above the piston 23 further drops to less than the atmospheric pressure (creating a so-called "thermal vacuum"). Accordingly, the piston 23 can be moved back to the initial top dead center position.

Then, the trigger switch 5 is turned OFF, and the user lifts the combustion-type nail gun 1 from the workpiece 28 for separating the push lever 9 from the workpiece 28. As a result, the push lever 9 and the combustion chamber frame 10 move away from the cylinder head 11 because of the biasing force of the compression coil spring 22 to restore a state shown in FIG. 1. Thus, the first and second flow passages 31 and 32 are provided. In this case, the fan 19 is configured to keep rotating for a predetermined period of time in spite of OFF state of the trigger switch 5. In the state shown in FIG. 1, fresh air flows into the combustion chamber 26 through the intake port 3*a* formed at the head cover 3 and through the flow passages 31, 32 as shown by an arrow "a1"~"a4", expelling the residual combustion gas out of the exhaust port 2*a*. Thus, the combustion chamber 26 is scavenged.

At the same time, air is sucked into the housing 2 through the air inlet port 2*b* as shown by an arrow "b1" by the rotation of the fan 19. The sucked air flows through the air passage 30*a* and passes along the outer side of the gauging 30B and is directed toward the fan 19 as shown by an arrow "b2". Then, the air flows radially outwardly of the fan 19 as shown by an arrow "b3", and then passes through the second flow passage 32 as indicated by an arrow "a4" and is discharged through the exhaust port 2*a*.

In this way, the air flow "b1" and "b2" cools the gas canister 30. Accordingly, even if the temperature of the cylinder 20 etc. is elevated due to the repeated operation of the tool 1, temperature increase of the gas canister 30 can be restrained to maintain the internal pressure of the gas canister 30 at approximately constant level. As a result, a constant amount of combustible gas can be supplied into the combustion chamber 26 to provide a stabilized ignition. Further, since the air inlet port 2*b* in the housing 2 is positioned near the end of the gas canister 30, the end being opposite to the gauging section 30B, an entirety of the gas canister 30 can be subjected to cooling.

The above-described advantage can be provided by forming the air inlet port 2*b* at the proper region of the housing 2. Thus, the temperature increase of the gas canister 30 can be restrained, thereby providing a constant amount of combustible gas, to thus realize the stabilized ignition performance. Then, the rotation of the fan 19 is stopped to restore an initial stationary state. Thereafter, subsequent nail driving operation can be performed by repeating the above described operation process.

While the invention has been described in detail and with reference to specific embodiments thereof, it would be apparent to those skilled in the art that various changes and modification may be made therein without departing from the scope of the invention. For example, the present invention is not limited to the nail gun but is available for any kind of power tools in which a combustion chamber and a piston are provided, and as long as expansion of gas as a result of combustion of air-fuel mixture in the combustion chamber causes reciprocal motion of the piston.

What is claimed is:

1. A combustion-type power tool comprising:

a housing including a gas canister accommodating section for accommodating a gas canister, the housing having one end and another end;

a cylinder head disposed at the one end and formed with a fuel passage allowing a combustible gas from the gas canister to pass therethrough;

a cylinder disposed in and fixed to the housing, the cylinder defining an axial direction;

a piston slidably disposed in the cylinder and reciprocally movable in the axial direction, the piston dividing the cylinder into an upper space above the piston and a lower space below the piston;

a combustion chamber frame disposed in the housing and movable in the axial direction, the combustion chamber frame being abuttable on the cylinder head to provide a combustion chamber in cooperation with the cylinder head and the piston;

a driver blade extending in the axial direction from the piston in the lower space; and an ignition plug exposed to the combustion chamber for igniting a mixture of air and the combustible gas in the combustion chamber; and wherein an air passage is defined between the gas canister accommodating section and the gas canister accommodated therein, the gas canister accommodating section being formed with an air inlet in communication with the air passage.

2. The combustion-type power tool as claimed in claim 1, further comprising:

a motor supported at the cylinder head and having a rotation shaft extending to the combustion chamber; and a fan fixed to the rotation shaft and disposed in the combustion chamber for agitating and mixing the air with the combustible gas; and wherein the housing is formed with an exhaust port for discharging exhaust gas; and wherein the gas canister includes a combustible gas accumulating section and a gauging section disposed at one end of the gas accumulating section for gauging the combustible gas; and wherein the air passage is configured to pass along at least an outer surface of the gauging section and is directed to the fan, the rotation of the fan sucking an air into the air passage through the air inlet port and discharging air through the exhaust port.

3. The combustion-type power tool as claimed in claim 2, wherein the combustion chamber frame is movable away from the cylinder head to provide a first flow passage in communication with an atmosphere and between the combustion chamber frame and the cylinder head, and a second flow passage in communication with the first flow passage and the exhaust port and between the combustion chamber frame and the cylinder.

4. The combustion-type power tool as claimed in claim 3, wherein the gas canister has another end opposite to the gauging section, the air inlet port being positioned near the another end of the gas canister.

5. A gas canister cooling arrangement in a combustion type power tool having a housing, the housing including a gas canister accommodating section for accommodating therein a gas canister, wherein an air passage is defined between the gas canister accommodating section and the gas canister accommodated therein, and wherein an air inlet of the air passage is formed at the gas canister accommodating section.

6. A combustion-type power tool comprising:

an outer frame including a gas canister accommodating section for accommodating a gas canister, a gas canister insertion opening being provided in the canister accommodating section;

wherein an air passage is defined between the gas canister accommodating section and the gas canister accommodated therein, the gas canister accommodating section being formed with an air inlet in communication with the air passage, the air inlet being independent of the canister insertion opening.

* * * * *